United States Patent [19]

Worley et al.

[11] Patent Number: 4,485,766

[45] Date of Patent: Dec. 4, 1984

[54] CONDUCTION COOLED TUBE SUPPORTS

[75] Inventors: Arthur C. Worley, Mt. Tabor; Charles Becht, IV, Morristown, both of N.J.

[73] Assignee: Exxon Research and Engineering Co., Florham Park, N.J.

[21] Appl. No.: 594,928

[22] Filed: Mar. 29, 1984

Related U.S. Application Data

[63] Continuation of Ser. No. 448,837, Dec. 10, 1982, abandoned.

[51] Int. Cl.[3] ..... F22B 37/24

[52] U.S. Cl. ..... 122/510; 122/356; 165/162

[58] Field of Search ..... 122/510, 511, 356; 165/162

[56] References Cited

U.S. PATENT DOCUMENTS

| | | | |
|---|---|---|---|
| 2,745,388 | 5/1956 | Becker | 122/356 |
| 3,240,204 | 3/1966 | P. von Wiesenthal | 126/109 |
| 3,385,271 | 5/1968 | Fleischer | 122/510 |
| 3,552,362 | 1/1971 | Francis | 122/510 |
| 3,938,476 | 2/1976 | R. F. Kaupp | 122/510 |
| 4,244,606 | 1/1981 | Abrahamson | 285/14 |

*Primary Examiner*—Henry C. Yuen
*Attorney, Agent, or Firm*—Joseph J. Dvorak

[57] ABSTRACT

In boilers, process tubes are suspended by means of support studs that are in thermal contact with and attached to the metal roof casing of the boiler and the upper bend portions of the process tubes. The support studs are sufficiently short that when the boiler is in use, the support studs are cooled by conduction of heat to the process tubes and the roof casing thereby maintaining the temperature of the stud so that it does not exceed 1400° F.

9 Claims, 3 Drawing Figures

CONDUCTION COOLED TUBE SUPPORTS

This is continuation of application Ser. No. 448,837, filed 12/10,82, abandoned.

FIELD OF THE INVENTION

The present invention relates to boiler tube supports and particularly to process tube supports for hybrid boilers.

BACKGROUND OF THE INVENTION

There are a number of techniques disclosed in the art for locating process tubes within high temperature boilers. Illustrative of such techniques are those disclosed in U.S. Pat. No. 3,385,271; U.S. Pat. No. 3,552,362 and U.S. Pat. No. 4,244,606. In actual practice, however, it is most common to have the process tubes which are located in boilers suspended by tube supports from a superstructure external the boiler roof casing. Thus, the process tubes located in the boiler have upper portions which extend through the boiler roof casing, form a bend, and return back down through the boiler roof casing. The tubes are suspended by tube supports attached to the bend of the tube and superstructure over the roof casing. Experience has shown that these precautions are necessary to avoid mechanical failure of the tube supports which would occur if the supports were located within the boiler where temperatures are generally above at least 1000° F. and often are as high as about 2000° F. and a corrosive atmosphere exists.

There are a number of disadvantages to the common tube support technique in practice, not the least of which is the difficulty associated with providing appropriate expansion joints in the region where the process tubes penetrate the casing of the boiler. Thus, there remains a need for a very simple and economical technique for supporting process tubes in a boiler chamber.

SUMMARY OF THE INVENTION

Briefly stated, a vertically disposed serpentine tubular coil is suspended within the convection section of a boiler chamber from the upper return bends of the tubular coil by means of metal supports which are in thermal contact with and attached to the upper return bends of the tubular coil. The supports pass through the insulation of the boiler roof and also are in thermal contact with and attached directly to the metal roof casing. The metal supports are sufficiently short that, under conditions of use, the supports are cooled by means of conduction of heat to the metal roof casing and the process tubes.

In one embodiment of the invention, a metal sleeve and insulation are provided around that portion of the support which extends from the upper return bend of the tubular coil to the boiler roof insulation.

In another embodiment, the support is a metal tube which has an opening above the roof casing and has a plurality of orifices in the tube wall within the boiler such that air from outside the boiler is aspirated from external the boiler through the tube and into the boiler thereby providing for additional cooling of the support.

These and other features of the present invention will be better understood by reading a detailed description of the invention in connection with the drawings.

THE DRAWINGS

DETAILED DESCRIPTION OF THE INVENTION

Figure 1:
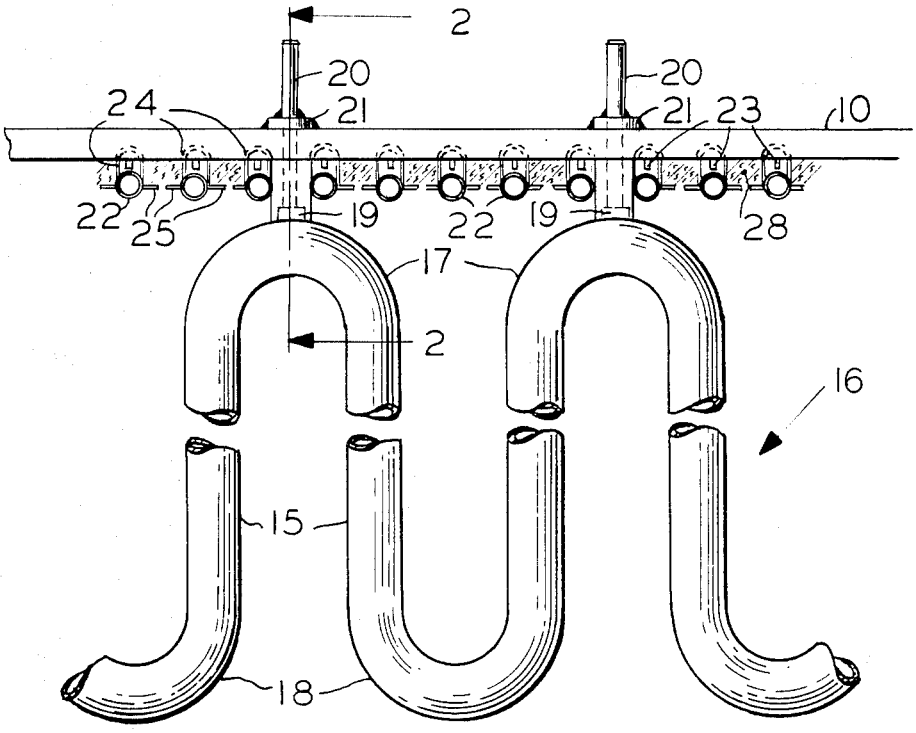
FIG. 1 is a schematic diagram illustrating the support of process tubes in a hybrid boiler in accordance with the present invention.
Figure 2:
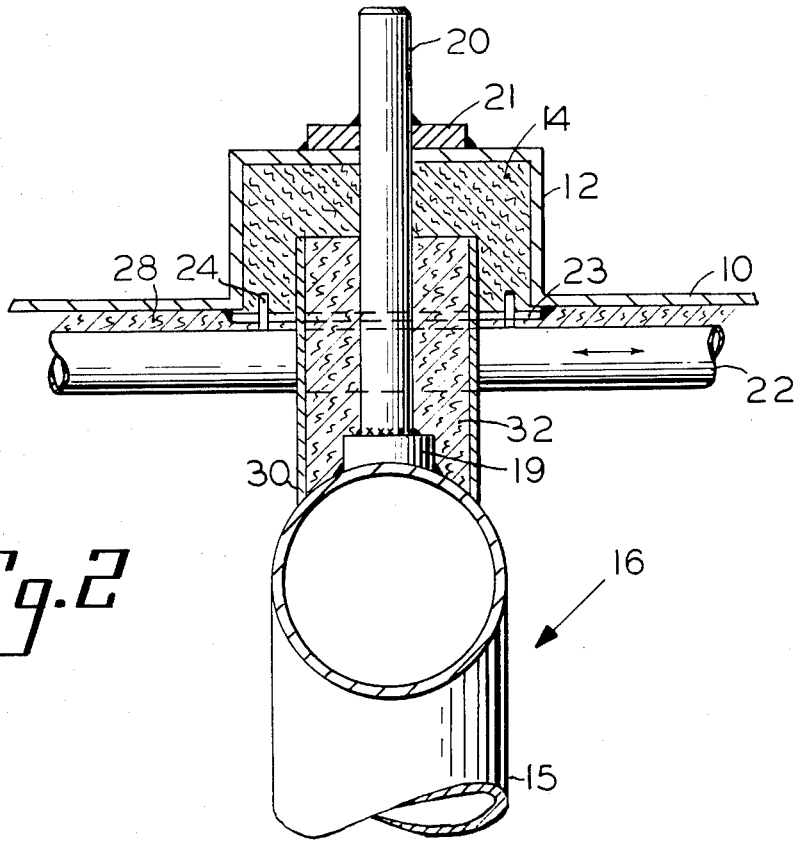
FIG. 2 is a cross-section of a view taken along lines 2,2 of FIG. 1.

Referring particularly to FIGS. 1 and 2 of the drawings, there is shown a metal roof casing 10 of a hybrid boiler. The boiler, of course, is provided with side walls and a floor (not shown) defining a convection section of the boiler. Preferably, roof casing 10 is provided with a plurality of upwardly directed channels 12 which extend along the length of the boiler roof. As can be seen in FIG. 2, an insulating material 14 is located within each of the upwardly directed channels 12. The insulating material is selected from typical boiler insulating materials such as refractory materials, ceramic fibers and the like.

Arranged within the convection section of the furnace are a plurality of serpentine tubes 16 for the passage therethrough of process fluid to be heated in the boiler. As shown in FIGS. 1 and 2, the serpentine process tube 16 has upper bend portions 17, lower bend portions 18 and straight run portons 15. The serpentine tube 16 is suspended in the boiler in accordance with the practice of the present invention as will be described herein in greater detail.

At substantially the mid-portion of each upper bend portion 17, there is provided a circular metal ring 19.

Ring 19 may be similar, for example, to a half socket welding pipe coupling. In any event, ring 19 is adapted to receive in engaging relationship and be in thermal contact with one end of supporting stud 20. As is shown in the drawings, stud 20 is attached by welding to ring 19; however, it should be readily appreciated that ring 19 and stud 20 may be threaded so that stud 20 can be screwed into ring 19.

In the practice of the present invention supporting stud 20 preferably is either a cyclindrical metal rod or tube. In any event, supporting stud 20 extends upwardly from ring 19 through the insulation 14 of channel 12 and through an opening in the roof casing 10 and roof casing reinforcing plate 21. The opening in the roof casing 10 and the reinforcing plate 21 are just sufficient to accommodate the passage of supporting stud 20. As can be seen in the figures, the supporting stud 20 is welded to the casing reinforcing plate 21 and the casing reinforcing plate 21, in turn, is welded to the roof casing 10. Thus, the support stud 20 is in thermal contact with and attached to both the metal roof casing 10 and the serpentine tube 16.

It should be readily appreciated that stud 20 may be attached to roof casing 10 by other techniques such as providing a threaded portion on the upper end of stud 20 and using a nut to retain stud 20 in position against reinforcing plate 21.

As is shown in the figures, the hybrid boiler includes horizontally disposed water tubes 22 which generally are arranged so as to run transverse to the direction of the serpentine tubes 16; however, water tubes 22 optionally may run parallel to the direction of the serpentine tubes 16. Also, as is shown, a plurality of support bars 23 are welded to the roof casing 10. Generally U-shaped connectors 24, which are welded to the tubular water pipes 22, hang from the support bar 23 so that the pipes 22 are suspended immediately below the roof casing 10 of the boiler.

In a preferred embodiment of the present invention, the water tubes 22 also are provided with horizonatally arranged fins 25 which serve to enhance the heat transfer efficiency of water tubes 22.

Heat loss to the exterior of the boiler is minimized by means of insulation 28 located, in general, between the top half of tubes 22 and the roof casing 10.

An extremely important feature of supporting stud 20 is that it be sufficiently short that when the furnace is in use, heat is conducted from stud 20 to roof casing 10 and process tube 16 so that the temperature of stud 20 will not exceed 1400° F. and preferably 1000° F. Thus, while the gases within the boiler and in contact with stud 20 may be as high as 2000° F., and even higher, stud 20 is cooled by conduction since it is in thermal contact with the process tube 16 and the roof casing 10, each of which are at considerably lower temperatures.

In a preferred embodiment, the protection of the support stud 20 by conductive cooling is enhanced by providing a metal sleeve 30 which extends downwardly from a position intermediate channel member 12 to the top surface of the upper bend portion 17 of tubes 16 and an insulating material 32, such as refractory insulation, ceramic fibers and the like, is located within the tubular sleeve 30. In this way, contact of the stud 20 with hot gases is minimized and heat transfer by conduction to the roof casing 10 is facilitated.

Figure 3:
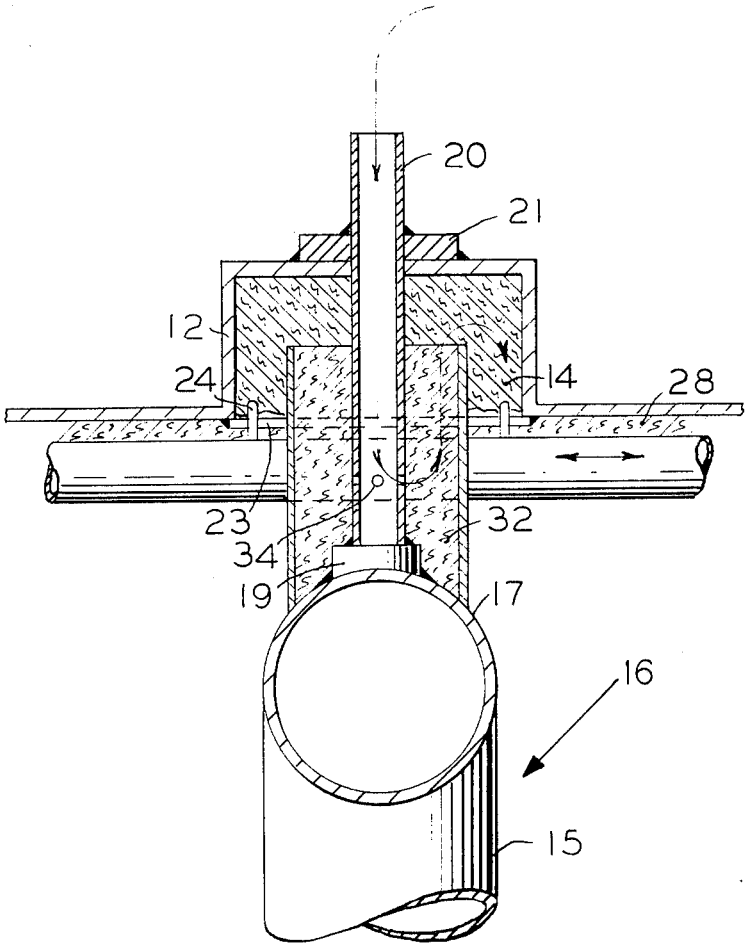
FIG. 3 is a schematic illustration of an alternate embodiment of the present invention.

In an alternate embodiment of the present invention, shown in FIG. 3, support stud 20 is a hollow tube which is open at one end to the atmosphere immediately above the roof of the boiler. Located along the circumference of the tube support stud 20 near the other end boiler within the boiler are a plurality of orifices. Since during operation of a hybrid boiler, the convection chamber tends to be at a pressure lower than atmospheric pressure, air will enter into the furnace chamber by passing downwardly through the tubular support stud 20 through orifices 34 and then through the porous insulating material 32. In this way, the support stud 20 also is cooled by convection, as well as by conduction to the roof casing 10 and tube 16.

As will be readily appreciated, there are many benefits to be gained by the practice of the present invention. For example, since the process tubes 16 are supported within the convection section of the boiler, the entire process tube surface serves as a heat input surface. In boiler designs such as that set forth in U.S. Pat. No. 3,385,271, where the process tubes penetrate the roof casing for external support, the effective heat input surface area of the tubes are significantly reduced. Consider also that tube surfaces located outside of the boiler provide a means for increased heat loss. Then too expansion joints are not required in the casing when the process tubes are supported in accordance with the present invention, thereby avoiding the problem of air leakage from or into the boiler. Moreover, fabrication and erection are simplified because roof penetrations are eliminated or simplified, except for the inlet and outlet connections of the process tubes. Very importantly, since the support studs are fabricated from common pipe components, the need for unusually designed parts with their associated higher costs is avoided.

What is claimed is:

1. In a hybrid boiler, a metal roof casing, insulation below said roof casing, horizontally disposed water tubes below said insulation, at least one serpentine process tube below said water tubes, said serpentine tube having substantially parallel and spaced apart vertical straight run portions joined by upper and bottom bend portions, metal sockets welded to substantially the mid point above each upper bend portion of said serpentine tubes, said metal sockets adapted to receive an engaging relationship support studs, support studs inserted in said metal sockets and welded thereto so as to be in thermal contact with and attached to the upper bend portions of said tube, said metal studs extending upwardly through the insulation, through the roof casing, and thence through a roof casing reinforcing plate, said roof casing reinforcing plate being welded to said roof casing, each metal stud being welded to said roof casing reinforcing plate so as to be in thermal contact with and attached to said roof casing, and each of the support studs being sufficiently short so that under conditions of use each of the studs are cooled by conduction as a result of being in thermal contact with said process tubes and said metal roof casing.

2. The boiler of claim 1 wherein said studs are sufficiently short so that under conditions of use, the temperature of said studs does not exceed 1400° F.

3. The boiler of claim 2 wherein the temperature of said studs does not exceed 1000° F.

4. The boiler of claim 1 including upwardly directed channels in said roof casing extending the length of said casing, insulation in said channels, said process tube located so that said studs extend upwardly through the insulation in the channel and through the roof casing.

5. The boiler of claim 4 including tubular metal sleeves surrounding the metal studs at least from the insulation in the channel to the upper bend of said tube and defining a space therebetween and insulation in the space between said studs and said metal sleeves.

6. The boiler of claim 5 wherein said studs are metal tubes each having an opening to the atmosphere above said roof and having a plurality of orifices around and through the circumference of a portion of said tube which is located beneath the roof casing whereby atmospheric air passes from said atmosphere to said furnace through said studs thereby providing additional cooling said support studs.

7. In a boiler of the type including a metal roof casing having insulation on the bottom surface of said metal roof casing and including a plurality of serpentine process tubes having straight run portions, upper bend portions and lower bend portions, said tubes located so that straight run portions are vertically disposed in said boiler, the improvement comprising metal sockets welded to substantially the mid portion of each upper bend portion of said serpentine tubes, metal support studs welded to said metal sockets so as to be attached to and in thermal contact with the upper bends of said process tubes, each of said support studs extending upwardly through said insulation, through said roof casing and a metal reinforcing member on the upper surface of said roof casing, each reinforcing member being welded to said roof casing, and each of said metal studs being welded to said reinforcing roof casing member, said studs being sufficiently short whereby said support studs are cooled by conduction as a result of being in thermal contact with said process tube and said roof casing.

8. The boiler of claim 7 including tubular metal sleeves surrounding the metal studs at least from the insulation to the upper bend of said tube and defining a space therebetween and insulation in the space between said studs and said metal sleeves.

9. The boiler of claim 7 wherein said studs are metal tubes each having an opening to the atmosphere above said roof casing and having a plurality of orifices around and through the circumference of a portion of said tube which is located beneath the roof casing whereby atmospheric air passes from said atmosphere to said furnace thereby providing additional cooling said support studs.

* * * * *

UNITED STATES PATENT AND TRADEMARK OFFICE

CERTIFICATE OF CORRECTION

PATENT NO. : 4,485,766

DATED : December 4, 1984

INVENTOR(S) : Arthur C. Worley et al

It is certified that error appears in the above-identified patent and that said Letters Patent is hereby corrected as shown below:

At column 1, line 6, after "abandoned", please insert the following new paragraph:

--The Government of the United States of America has rights in this invention pursuant to Contract No. DE-FC05-77ET-10069 awarded by the United States Energy Research and Development Administration, now the United States Department of Energy.--

Signed and Sealed this

*Eleventh* Day of *June 1985*

[SEAL]

*Attest:*

DONALD J. QUIGG

*Attesting Officer* *Acting Commissioner of Patents and Trademarks*